United States Patent [19]

Anahara et al.

[11] Patent Number: 4,672,804

[45] Date of Patent: Jun. 16, 1987

[54] FRICTION SPINNING APPARATUS

[75] Inventors: Meiji Anahara; Shigeru Muramatsu; Isamu Takagi; Masayoshi Tuboi, all of Kariya, Japan

[73] Assignee: Kabushiki Kaisha Toyoda Jidoshokki Seisakusho, Aichi, Japan

[21] Appl. No.: 894,649

[22] Filed: Aug. 8, 1986

[30] Foreign Application Priority Data

Aug. 10, 1985 [JP] Japan ..... 60-176266

[51] Int. Cl.[4] ..... D01H 7/885; D01H 7/892

[52] U.S. Cl. ..... 57/401; 57/411; 57/413

[58] Field of Search ..... 57/401, 408, 409, 411, 57/412, 413

[56] References Cited

U.S. PATENT DOCUMENTS

| | | | |
|---|---|---|---|
| 3,126,697 | 3/1964 | Cizek et al. | 57/413 |
| 3,721,070 | 3/1973 | Minami et al. | 57/413 X |
| 4,539,807 | 9/1985 | Stahlecker | 57/401 |
| 4,567,722 | 2/1986 | Stahlecker | 57/413 X |
| 4,574,582 | 3/1986 | Derichs | 57/401 |
| 4,584,832 | 4/1986 | Stahlecker | 57/401 |
| 4,606,187 | 8/1986 | Stahlecker | 57/401 |

*Primary Examiner*—John Petrakes

*Attorney, Agent, or Firm*—Burgess, Ryan & Wayne

[57] ABSTRACT

A friction spinning apparatus comprises a combing roller (19) for opening and feeding fibers in a duct (16, 15) to a throat (Q) formed between the outer surfaces of a pair of perforated and smooth surface drums (10, 12) arranged in parallel to each other and rotating in the same direction. A yarn (Y) formed at the throat (Q), by frictional contact between the fed fibers and the surfaces caused by a suction force, is withdrawn along the throat (Q). The duct (15, 16) is arranged to feed the fibers in an air stream having a direction inclined to the yarn axis (YL) and has a nozzle (17) in the form of a double pipe in the midportion thereof. A compressed air is ejected from the annular slit (17*a*) between the inner and outer pipe of the nozzle (17) to drag the fibers out from the nozzle (17) to cause them to stretch, whereby the fibers can be conveyed on the throat (Q) in the stretched state.

4 Claims, 14 Drawing Figures

Fig. 11
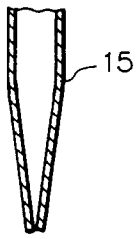
Fig. 12
PRIOR ART
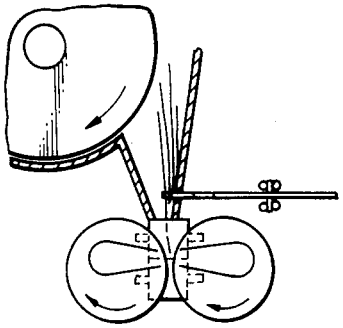
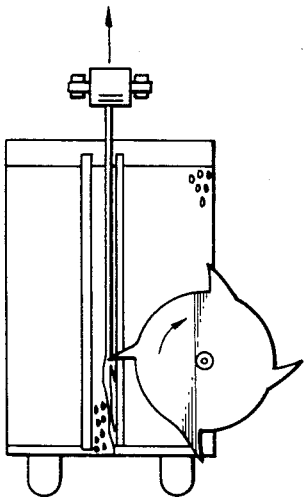
Fig. 13
PRIOR ART
Fig. 14
PRIOR ART
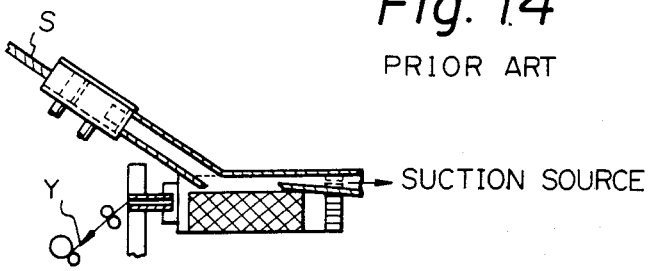

FRICTION SPINNING APPARATUS

BACKGROUND OF THE INVENTION

1. Field of the Invention

The present invention relates to an apparatus for spinning a yarn from natural and/or synthetic staple fibers, particularly to a friction spinning apparatus comprising a yarn formation surface, a fiber feed duct for conveying fibers onto the surface, means for moving the surface to twist the fibers deposited thereon to form a yarn and means for withdrawing the yarn transversely to the direction of motion of the surface.

2. Description of the Related Arts

In a known type friction spinning apparatus, the fibers are fed into a throat formed between the adjacent peripheral surface of two parallel drums rotating in the same direction. By friction contact with the moving drum surfaces, the fibers in the throat are twisted into a yarn which is then withdrawn transversely of the movement of the drum surfaces.

One of the most serious problems with the above type friction spinning apparatus is that the fibers supplied to the throat are deposited unsatisfactorily in the region of the tail end of a fiber bundle being spun for incorporation therein.

To solve this problem, an apparatus is proposed in U.S. Pat. No. 4,315,398, in which, besides a suction stream by which the fibers are held on the drum surface, an additional air stream is generated by means of a suction source in the direction generally parallel to the yarn axis and at a location adjacent the twisting surface in a fiber feed duct arranged to feed the fibers directly onto the area from which the yarn is withdrawn, whereby part of the fibers are stretched along the yarn axis and the correct deposit thereof into the yarn is enhanced (see FIG. 14). This apparatus, however, has drawbacks in that a considerable amount of effective fibers is sucked out by the additional stream causing the increase of waste and, further, the fibers tend to deposit at a turning point of the stream on the inner wall of the fiber feed duct.

Another apparatus is proposed in German Patent Publication DOS No. 27 20 625, as shown in FIGS. 12 and 13, in which fibers fed through a fiber feed path to a yarn formation surface are intermittently beaten by a disc with a sawtooth periphery, which disc is rotating in a plane perpendicular to the flying direction of the fibers, while the tip end of the saw teeth thereof is inserted into the fiber feed duct through a guide wall confining the fiber feed path. The fibers are thrown toward a means for withdrawing the yarn formed on the yarn formation surface, whereby the orientation of the fibers is improved to be parallel to the yarn axis. This apparatus, however, is sophisticated and liable to malfunction due to the provision of the rotating disc which requires a driving means associated therewith.

SUMMARY OF THE INVENTION

It is an object of the present invention to provide an improved friction spinning apparatus, particularly one in which the orientation of fibers in the yarn is improved by improvements to the fiber duct means.

This object is achievable by a friction spinning apparatus comprising a yarn formation surface, fiber feed means for feeding discrete fibers to the surface, comprising a combing roller for opening a sliver to the individual discrete fibers, fiber duct means for conveying the fibers from the fiber feed means to the yarn formation surface, a part of the periphery of the combing roller being exposed in the upper region of the fiber duct means, surface moving means for moving the yarn formation surface in such a manner as to twist the discrete fibers conveyed thereto and deposited thereon to form a yarn thereby, yarn withdrawal means for withdrawing the formed yarn from the surface in a direction transverse to the direction of movement of the surface, and fiber suction means for providing an air stream within the duct means to suck the discrete fibers and move the same through the duct means from the fiber feed means to the yarn formation surface, characterized in that the axis of the fiber duct means tangentially passing the exposed periphery of the combing roller and reaching the yarn formation surface intersects the axis of the yarn formed on and withdrawn from the yarn forming surface at an acute angle relative to the yarn withdrawing direction, and in that the fiber duct means is formed as a nozzle means of a double pipe type, comprising concentric outer and inner pipes, in the midportion thereof, an exit of the inner pipe being directed to the yarn formation surface, a compressed air source being connected to an annular slit provided between the outer and inner pipes for ejecting an air stream in the direction of fiber transportation, whereby the fiber passing through the inner pipe is positively sucked out therefrom and advanced to the yarn formation surface in the stretched state.

Preferably, the fiber duct means has a rectangular or oval cross section elongated along the width of the combing roller in the upper region adjacent to the periphery of the combing roller, a circular cross section in the midportion near the nozzle means, and a slit-like discharging mouth directly facing the yarn formation surface and elongated therealong in the lower region, the cross section of the fiber duct means being gradually decreased from the midportion toward the lower region so as to accelerate a speed of the fibers conveyed.

Advantageously, the surface moving means comprises a pair of parallel drums rotating in the same direction, one having a smooth surface and other having a perforated surface with a plurality of perforations, and the fiber suction means comprises a suction pipe arranged within the interior of the perforated drum and having a slit along the width of the perforated drum, whereby a suction stream is provided from the slit through the perforations to the fiber duct means.

The discharging mouth of the fiber duct means is preferably arranged to face the slit of the suction pipe.

BRIEF DESCRIPTION OF THE DRAWINGS

Other objects and advantages of the present invention will be more apparent from the following description with reference to the attached drawings illustrating a preferred embodiment of the present invention, wherein;

FIGS. 5 through 11 are cross sections of a fiber duct means taken along planes U—U, V—V, $W_1$—$W_1$, $W_2$—$W_2$, $W_3$—$W_3$, X—X, and Z—Z, respectively; and FIGS. 12 through 14 illustrate parts of prior art apparatus.

PREFERRED EMBODIMENTS OF THE PRESENT INVENTION

Figure 3:
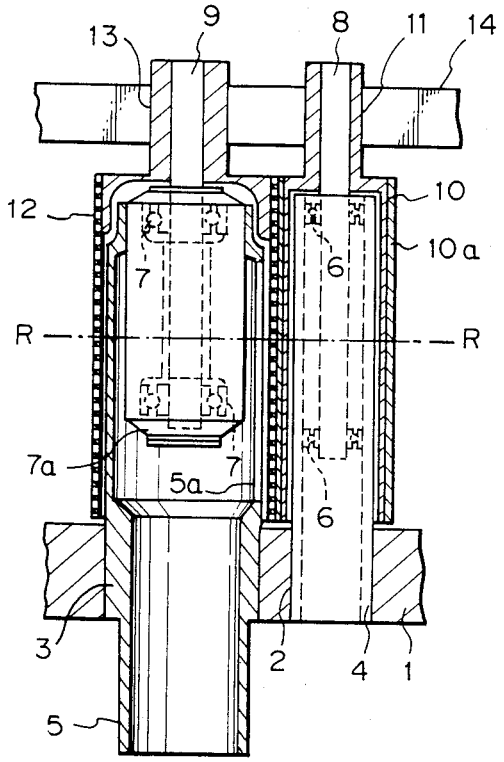
FIG. 3 is a section taken along a plane S–S in FIG. 2.

FIG. 3 shows a pair of drums constituting a surface moving means and a fiber suction means according to the present invention. Adjacent apertures 2, 3 are provided in a machine frame 1. Two tubular supports 4 and 5 are fixedly mounted in the apertures 2, 3, respectively. A suction source (not shown) is connected at one end of the support 5. The support 5 is provided with a slit 5*a* in the periphery thereof in the longitudinal direction so as to function as a suction pipe. Inside of the support 4 is secured a pair of bearings 6, 6 and, therethrough, a shaft 8 is inserted so as to rotate relative to the support 4, with an end of the shaft 8 being projected out of the support 4. The suction pipe 5 has a narrow inner diameter portion at an upper end thereof, in which a housing 7*a* for accommodating a pair of bearings 7, 7 is inserted and through which a shaft 9 is inserted so as to rotate relative to the housing 7*a*, with an end of the shaft 9 being projected out of the housing 7*a*.

A smooth surface drum 10 is arranged to encase the support 4 therein in such a manner that a neck portion 11 of the drum 10 is fixedly secured onto the projected portion of the shaft 8, whereby the drum 10 is rotatable relative to the support 4 as the shaft 8 rotates. The outer surface of the drum 10 is covered with a resilient covering 10*a*, such as polyurethane or the like. On the other hand, a perforated drum 12 having a plurality of perforations on the outer surface thereof is arranged to encase the suction pipe 5 therein in such a manner that a neck portion 13 of the drum 12 is fixedly secured onto the projected portion of the shaft 9, whereby the drum 12 is rotatable relative to the suction pipe 5 as the shaft 9 rotates.

Both the drums 10 and 12 are positioned in parallel to each other so that a small gap is provided between the outer surfaces thereof and driven in the same direction by a running belt 14 engaged with the periphery of the neck portions 11, 13. A yarn formation surface is defined by a throat Q formed with the surfaces of the two drums 10, 12. In this regard, the suction pipe 5 is arranged so that the slit 5*a* is positioned to face the throat Q, whereby a suction stream flowing into the perforated drum 12 is applied to the throat Q.

Figure 1:
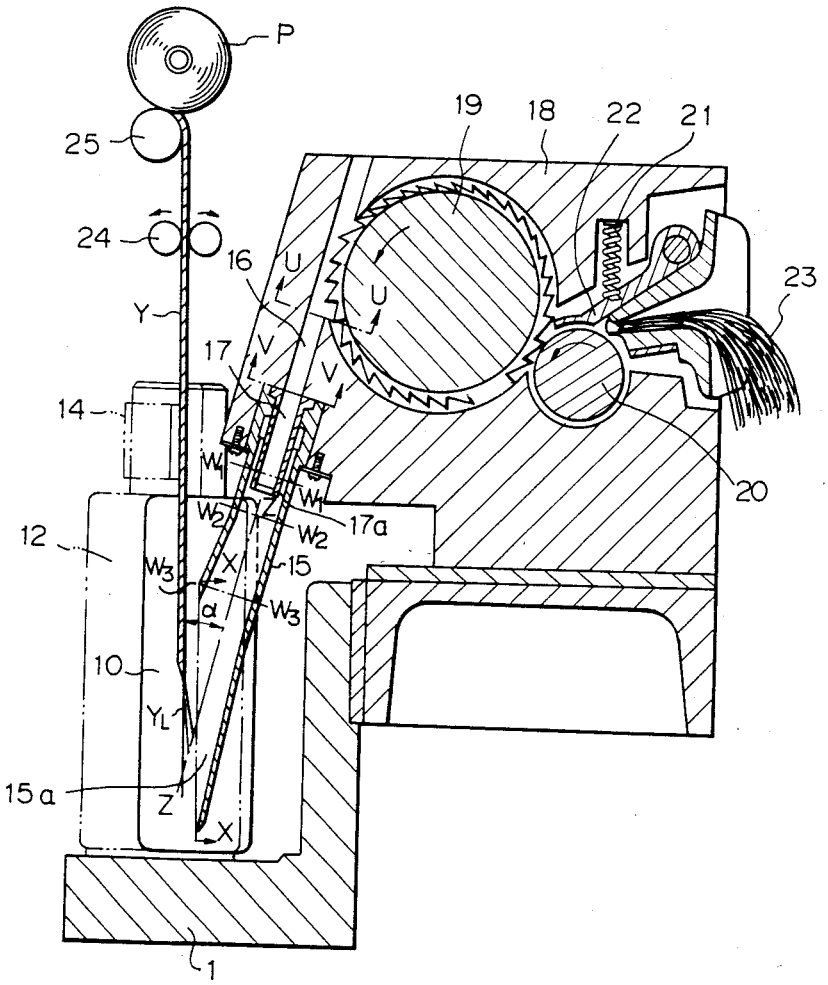
FIG. 1 is a side elevational view of a spinning apparatus of the present invention.
Figure 2:
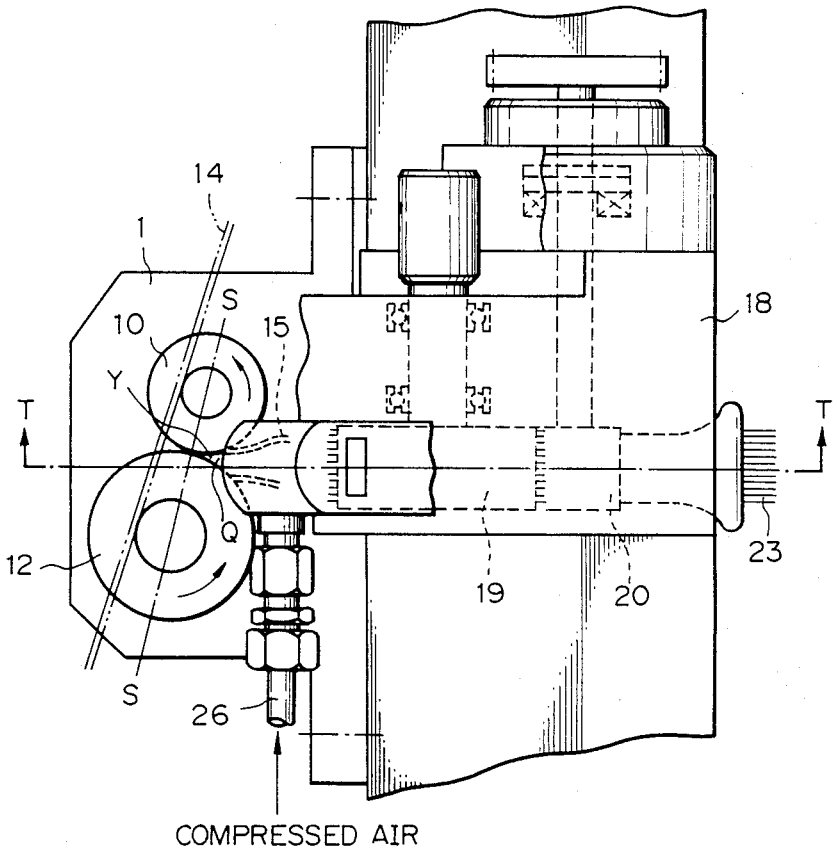
FIG. 2 is a plan view of the apparatus of FIG. 1.
Figure 4:
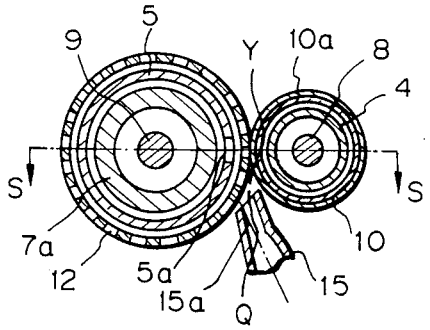
FIG. 4 is a section taken along a plane R–R in FIG. 3.

As shown in FIGS. 1, 2, and 4, a fiber duct means including a fiber channel 16 in the upstream region and a duct 15 following the fiber channel 16 and having a discharging mouth 15*a* in the shape complementary to that of the throat Q is arranged on one side of the drums 10, 12 so that the mouth 15*a* is positioned against the slit 5*a* of the suction pipe 5. A fiber feed means 18 including a combing roller 19 is provided adjacent to the fiber channel 16. The combing roller 19 is arranged to open a silver 23, supplied by means of a fluted roller 20 and a presser 22 biased by a spring 21, into discrete fibers and feed them to the fiber channel 16 from the periphery of the combing roller 19 emerging in the upper region of the duct 15.

Figure 5:
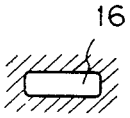
Figure 6:
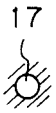
Figure 7:
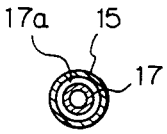
Figure 8:
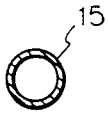
Figure 9:
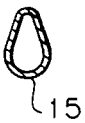
Figure 10:
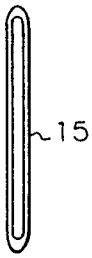

The fiber channel 16 has a rectangular cross section, in the region in which the combing roller 19 emerges, elongated along the width of the combing roller, as shown in FIG. 5, so that the fibers opened by the combing roller 19 are smoothly transferred into the fiber channel 16. The fiber channel 16 forms a nozzle 17 at the front end thereof onto which the rear end of the duct 15 is inserted, whereby a double pipe structure having the nozzle 17 as an inner pipe and the duct 15 as an outer pipe is formed in the border therebetween. A pipe 26 communicating with a compressed air source (not shown) is connected to a side wall of the duct 15 at the abovesaid region so that compressed air is supplied into an annular space 17*a* formed between the nozzle 17 and the duct 15 and ejected therefrom along an inner wall of the duct 15 in the fiber conveying direction. According to this double pipe structure, the fibers opened by the combing roller 19 and conveyed through the fiber channel 16 are accelerated when they pass through the nozzle 17 by a dragging force caused by the air stream ejected from the annular space 17*a*. This acceleration makes the fibers stretch in the longitudinal direction thereof and the fibers are deposited on the throat Q through the mouth 15*a*, while keeping the stretched state. This acceleration is enhanced by the reduction of the cross sectional area of the duct 15 toward the downstream region as shown in FIGS. 8, 9, and 10.

The axis Z—Z of the fiber duct means (substantially corresponding to that of the nozzle 17) intersects the axis of the yarn formation surface YL at an acute angle $\alpha$ within a range of from 10° to 45° relative to the direction of yarn withdrawal, which enhances the safe landing of the fibers on the drum surface substantially in parallel to the yarn formation axis without disturbance of their stretched state. The fibers on the drum surface are firmly held thereon by the suction applied through the perforation of the perforated drum 12 as well as the pressure caused by the ejected stream from the annular space 17*a*, and twisted to form a yarn Y by the friction between them and the drums as the drums 10, 12 are rotating. Thereafter, the yarn is withdrawn from the yarn formation surface, that is, the throat Q, by means of a delivery roller 24 and wound on a package P by a take-up drum 25.

The effect of the present invention will be apparent from the following example:

EXAMPLE

A cotton yarn of 20's was spun by utilizing the abovesaid apparatus according to the present invention, with a withdrawal speed of 250 m/min. A length of the mouth of the duct was 60 mm and that of the suction slit of the suction pipe was 65 mm, and the angle $\alpha$° between the axis of the fiber duct means and the yarn formation surface was 15°.

As a blank, the same run was carried out except that the air ejection from the annular space of the nozzle portion was eliminated.

The tested results thereof were as follows:

Without air ejection: breakage strength 235 g, U% 12.5;

With air ejection: breakage strength 280 g, U% 11.3.

As stated above, according to the present invention, since the nozzle 17 is provided in the midportion of the fiber duct means and the air is ejected from the annular space 17*a* around the exit of the nozzle 17 to envelop the fibers passing through the nozzle, the fibers conveyed are prevented from touching the wall surface of the duct 15. Since the axis of the fiber duct means intersects the axis of the yarn formation surface at an acute angle $\alpha$, the fibers can safely land on the yarn formation surface without disturbing the parallelism thereof, whereby the resultant yarn has an excellent uniformity of thickness and breakage strength.

Further, the air stream ejected from the annular space enhances the stretching of the fibers without the drawbacks of a need for sophisticated apparatus, as in the case of the prior art, because no moving part exists in the fiber duct means. Since the fiber duct means in the nozzle portion has a circular cross section, it is easy to manufacture it with a high accuracy and to connect it to other parts, which, in turn, results in no deposit of the fibers on the connected portion in the fiber duct means.

Since the positions of the suction slit within the interior of the perforated drum and the discharging mouth of the duct correspond to each other along the axis of the yarn formation surface so that the suction is effectively applied thereon, the fibers can be uniformly deposited on the surface and firmly held thereon.

Since holding of the fibers on the yarn formation surface is improved by the elevated air pressure on the outer surface of the perforated drum due to the air stream added by the ejection of the compressed air, the twist efficiency is also improved, that is, slippage of the fiber bundle on the drum surface is decreased during twisting, which eliminates wear of the drum surface. This also means that the relative rotational speed of the drums can be decreased compared to the prior art to obtain the yarn of the same twist at the same yarn withdrawal speed and thus save the production energy.

We claim:

1. A friction spinning apparatus comprising a yarn formation surface, fiber feed means for feeding discrete fibers to the surface, comprising a combing roller for opening a sliver to the individual discrete fibers, fiber duct means for conveying the fibers from the fiber feed means to the yarn formation surface, a part of the periphery of the combing roller being exposed in the upper region of the fiber duct means, surface moving means for moving the yarn formation surface in such a manner as to twist the discrete fibers conveyed thereto and deposited thereon to form a yarn thereby, yarn withdrawal means for withdrawing the formed yarn from the surface in a direction transverse to the direction of movement of the surface, and fiber suction means for providing an air stream within the duct means to suck the discrete fibers and move the same through the duct means from the fiber feed means to the yarn formation surface, characterized in that the axis of the fiber duct means tangentially passing the exposed periphery of the combing roller and reaching the yarn formation surface intersects the axis of the yarn formed on and withdrawn from the yarn forming surface at an acute angle relative to the yarn withdrawing direction, and in that the fiber duct means is formed as a nozzle means of a double pipe type, comprising concentric outer and inner pipes, in the midportion thereof, an exit of the inner pipe being directed to the yarn formation surface, a compressed air source being connected to an annular slit provided between the outer and inner pipes for ejecting an air stream in the direction of fiber transportation, whereby the fiber passing through the inner pipe is positively sucked out therefrom and advanced to the yarn formation surface in the stretched state.

2. An apparatus as defined by claim 1, characterized in that, the fiber duct means has a rectangular or oval cross section elongated along the width of the combing roller in the upper region adjacent to the periphery of the combing roller, a circular cross section in the midportion near the nozzle means, and a slit-like discharging mouth directly facing the yarn formation surface and elongated there along in the lower region, the cross section of the fiber duct means being gradually decreased from the midportion toward the lower region so as to accelerate a speed of the fibers conveyed.

3. An apparatus as defined by claim 1, characterized in that, the surface moving means comprises a pair of parallel drums rotating in the same direction, one having a smooth surface and other having a perforated surface with a plurality of perforations, and the fiber suction means comprises a suction pipe arranged within the interior of the perforated drum and having a slit along the width of the perforated drum, whereby a suction stream is provided from the slit through the perforations to the fiber duct means.

4. An apparatus as defined by claim 3, characterized in that, the discharging mouth of the fiber duct means is arranged to face the slit of the suction pipe.

* * * * *